United States Patent [19]

Tsutsui et al.

[11] 4,060,062

[45] Nov. 29, 1977

[54] CARBURETOR CHOKE VALVE CONTROL SYSTEM APPARATUS

[75] Inventors: Katsuhiko Tsutsui; Heihachi Miura; Yukio Miyano, all of Kawasaki, Japan

[73] Assignee: Honda Giken Kogyo Kabushiki Kaisha, Tokyo, Japan

[21] Appl. No.: 628,087

[22] Filed: Nov. 3, 1975

[30] Foreign Application Priority Data

Nov. 6, 1974 Japan ..... 49-127716

[51] Int. Cl.[2] ..... F02B 75/02; F02D 39/02

[52] U.S. Cl. ..... 123/75 B; 123/119 F; 123/127; 123/DIG. 4; 261/23 A

[58] Field of Search ..... 123/75 B, 119 F, 127, 123/DIG. 4, 32 ST, 179 G; 261/23 A

[56] References Cited

U.S. PATENT DOCUMENTS

| | | | |
|---|---|---|---|
| 3,443,552 | 5/1969 | Von Seggern | 123/75 B |
| 3,659,564 | 5/1972 | Suzuki | 261/23 A |
| 3,785,624 | 1/1974 | Marsee | 261/23 A |
| 3,837,322 | 9/1974 | Shishido | 123/75 B |
| 3,882,831 | 5/1975 | Date | 123/75 B |
| 3,941,105 | 3/1976 | Yagi | 123/75 B |
| 3,967,600 | 7/1976 | Iiyama | 123/75 B |
| 3,982,507 | 9/1976 | Asaka | 123/75 B |

*Primary Examiner*—Ronald H. Lazarus
*Assistant Examiner*—Daniel J. O'Connor
*Attorney, Agent, or Firm*—Lyon & Lyon

[57] ABSTRACT

A carburetor having a main intake passage for a lean mixture and an auxiliary intake passage for a rich mixture is provided with a choke valve in each passage. A control mechanism for operating the two choke valves includes a lost-motion connection so that the main choke valve is at the first to be moved toward closed position, for cold starting of the engine. For colder temperatures, both choke valves are moved toward closed position, and for very cold starting conditions, both choke valves are moved to fully closed position. The control mechanism may be manually operated or it may be automatic under the control of a bimetal element. When the engine on being started reaches a state of complete firing, with stable RPM, both choke valves are opened to predetermined pull-down angles.

6 Claims, 3 Drawing Figures

CARBURETOR CHOKE VALVE CONTROL SYSTEM APPARATUS

This invention relates to a choke valve control system in a carburetor of the type which is employed with an internal cumbustion engine in which each main combustion chamber has an auxiliary combustion chamber connected thereto by a torch opening. A rich mixture in the small auxiliary combustion chamber is ignited by a spark plug and the flame generated there is expelled through the torch opening to ignite a lean mixture in the larger main combustion chamber. Upon cold starting of such an engine, some fuel remains as liquid droplets adhering to the intake pipe walls, and in order to improve the air-fuel ratio of the mixtures in the combustion chambers, choke valves are provided in the carburetor intake passages. By this means the electrical ignitability and the flame ignitability are both improved.

However, under severe cold conditions in which the ambient air temperatures may be −20° C or lower, atomization and evaporation of the fuel in the carburetor is severely limited. If the only choke valve is provided in the main intake passage, and none in the auxiliary intake passage, it becomes difficult to produce in the auxiliary combustion chamber a mixture rich enough for reliable spark ignition, and as a result it is difficult to start the engine.

The object of this invention, therefore, is to provide a choke valve control system in a carburetor which is capable of starting the engine easily even during the coldest ambient temperatures. Other and more detailed objects and advantages will appear hereinafter.

Figure 1:
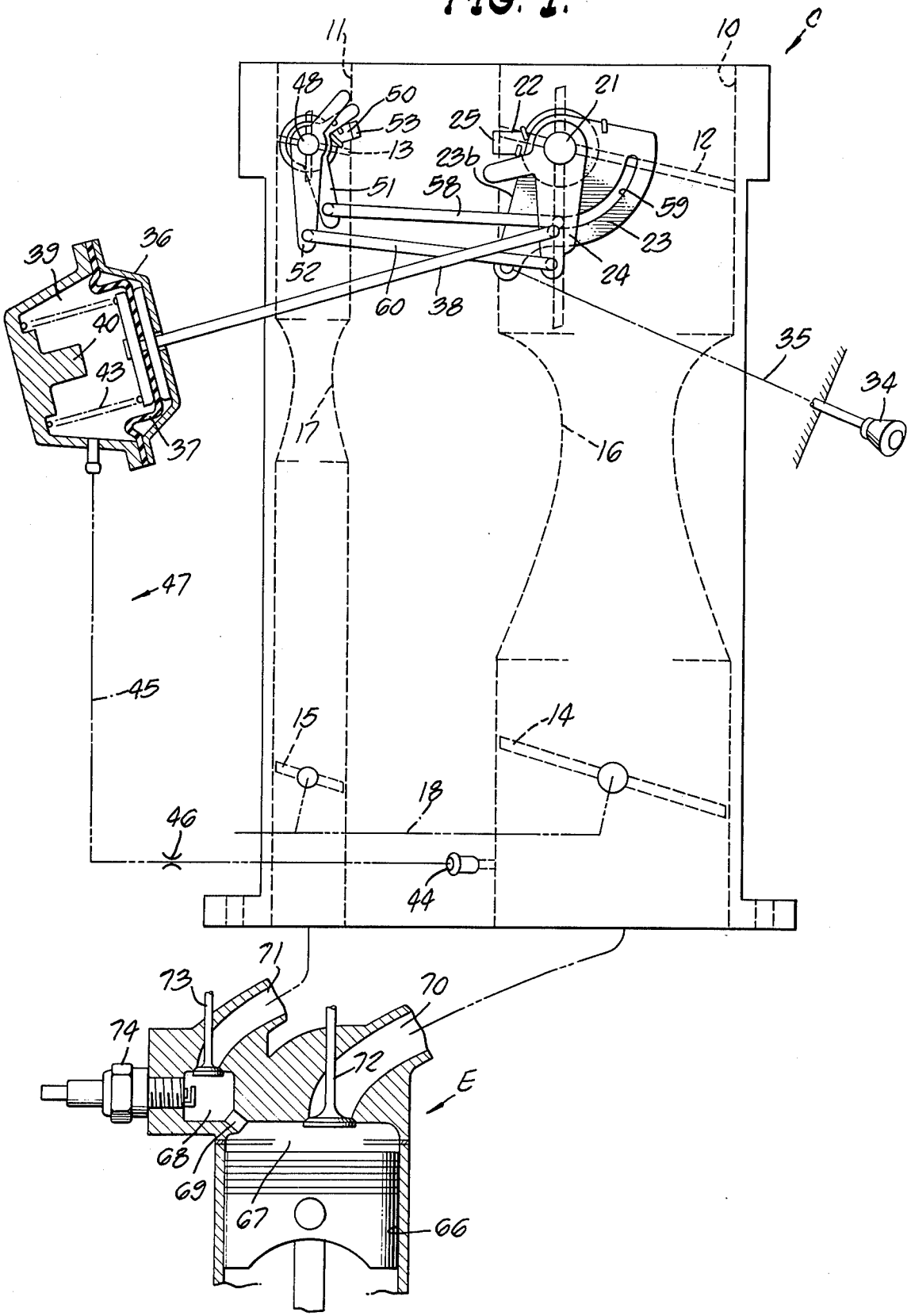
FIG. 1 is a side elevation partly in section, showing a preferred embodiment of this invention in diagrammatic form.

Referring to the drawings, the carburetor C is provided with a main intake passage 10 for a lean mixture and an auxiliary intake passage 11 for a rich mixture. A main choke valve 12 is positioned in the main intake passage 10 upstream from the main venturi 16, and an auxiliary choke valve 13 is positioned in the auxiliary intake passage 11 upstream from the auxiliary venturi 17. Each venturi 16 and 17 and each throttle valve 14 and 15 are provided with conventional fuel nozzles for high speed use, low speed use, etc., not shown. The throttle valves 14 and 15 are interconnected through linkage 18 to a common accelerator pedal, not shown.

The valve shaft 21 to which the main choke valve 12 is secured has a projecting end to which a main first choke lever 22 is fixed. A main second choke lever 23 and a main third choke lever 24 are mounted for rotation relative to the valve shaft 21. A portion of the main first choke lever 22 is bent toward the other two levers 23 and 24 to form a hook 25. The main first choke lever 22 and the main second choke lever 23 are connected to each other by means of a torsion spring 26 so that the hook 25 may be held in contact with the front edge **23*b* of the lever 23. A valve opening torsion spring 29 connects the first lever 22** to a stationary portion of the carburetor C.

The main second choke lever 23 is connected by a wire 35 to the choke operating knob 34, which is provided for manual operation by the driver of the vehicle. The main third choke lever 24 is connected through rod 38 to the diaphragm 37 of the vacuum actuator 36, installed in a suitable location on the carburetor C. The vacuum actuator 36 has a vacuum chamber 39 formed on one side of the flexible diaphragm 37, and an abutment 40 is provided within the chamber 39 to limit the stroke of the diphragm 37. A return spring 43 is positioned within the vacuum chamber 39 and acts to move the diaphragm 37 in a direction to extend the connecting rod 38. A vacuum detector opening 44 communicates with the main intake passage 10 downstream from the main throttle valve 14, and this opening 44 is connected through vacuum conduit 45 and orifice 46 to the vacuum chamber 39. The vacuum actuator 36 and the orifice 46 form a vacuum detector mechanism, generally designated 47, which operates in response to intensity of the intake vacuum when the internal combustion engine E reaches the state of complete firing, as described below.

On the valve shaft 48 of the auxiliary choke valve 13 there is fixed the auxiliary first choke lever 50 having a hook 53. The auxiliary second choke lever 51 and the auxiliary third choke lever 52 are each mounted to turn relative to the valve shaft 48. The connecting spring 54 connects the first and second levers and the valve opening spring 55 connects the first lever 50 to the body of the carburetor C. A rod 58 connects the second lever 51 on the auxiliary valve shaft 48 to the second lever 23 by means of a lost-motion connection provided by the arcuate slot 59. When the main second choke lever 23 turns in the direction to close the main choke valve 12, rotation of the auxiliary second choke lever 51 is delayed by an amount equal to the idling interval caused by travel of the arcuate slot 59 relative to the connecting rod 58.

Another rod 60 connects the main third choke lever 24 to the auxiliary third choke lever 52, so that motion of the vacuum actuator rod 38 is communicated to the auxiliary third choke lever 52. The cooperating parts 61 and 62 limit the extent of opening movement of the main choke valve 12, and similarly, the cooperating parts 63 and 64 limit the opening movement of the auxiliary choke valve 13.

The internal combustion engine generally designated E is equipped with said carburetor C, and it has a main combustion chamber 67 associated with each cylinder 66 and a small auxiliary combustion chamber 68 connected thereto through a torch opening 69. A main intake port 70 is connected to the main intake passage 10 in the carburetor C, and an auxiliary intake port 71 is connected to the auxiliary intake passage 11. The main intake port 70 communicates with the main combustion chamber 67 by way of the main intake valve 72. The auxiliary intake port 71 communicates with the auxiliary combustion chamber 68 by way of the auxiliary intake valve 73. An exhause port and exhaust valve, not shown, control the exhaust from the main combustion chamber 67. A spark plug 74 is positioned to ignite a combustible mixture in the auxiliary chamber 68 and this projects a flame through the torch opening 69 to ignite the relatively lean mixture in the main combustion chamber 67.

During the suction stroke of the piston, a lean mixture is drawn into the main combustion chamber 67 from the main intake port 70, and at the same time rich mixture is drawn into the auxiliary combustion chamber 68 from the auxiliary intake port 71. Some of this rich mixture is also drawn through the torch opening into the main combustion chamber 67. During the following compression stroke, with all of the valves closed, some of the lean mixture is returned from the main combustion chamber 67 through the torch opening to dilute the rich mixture in the auxiliary combustion chamber 68, so that at the time of firing of the spark plug 74 the mixture in the auxiliary combustion chamber 68 is easily ignitable. The overall air-fuel ratio of the mixtures supplied by the carburetor C is leaner than the stoichiometric air-fuel ratio.

Figure 2:
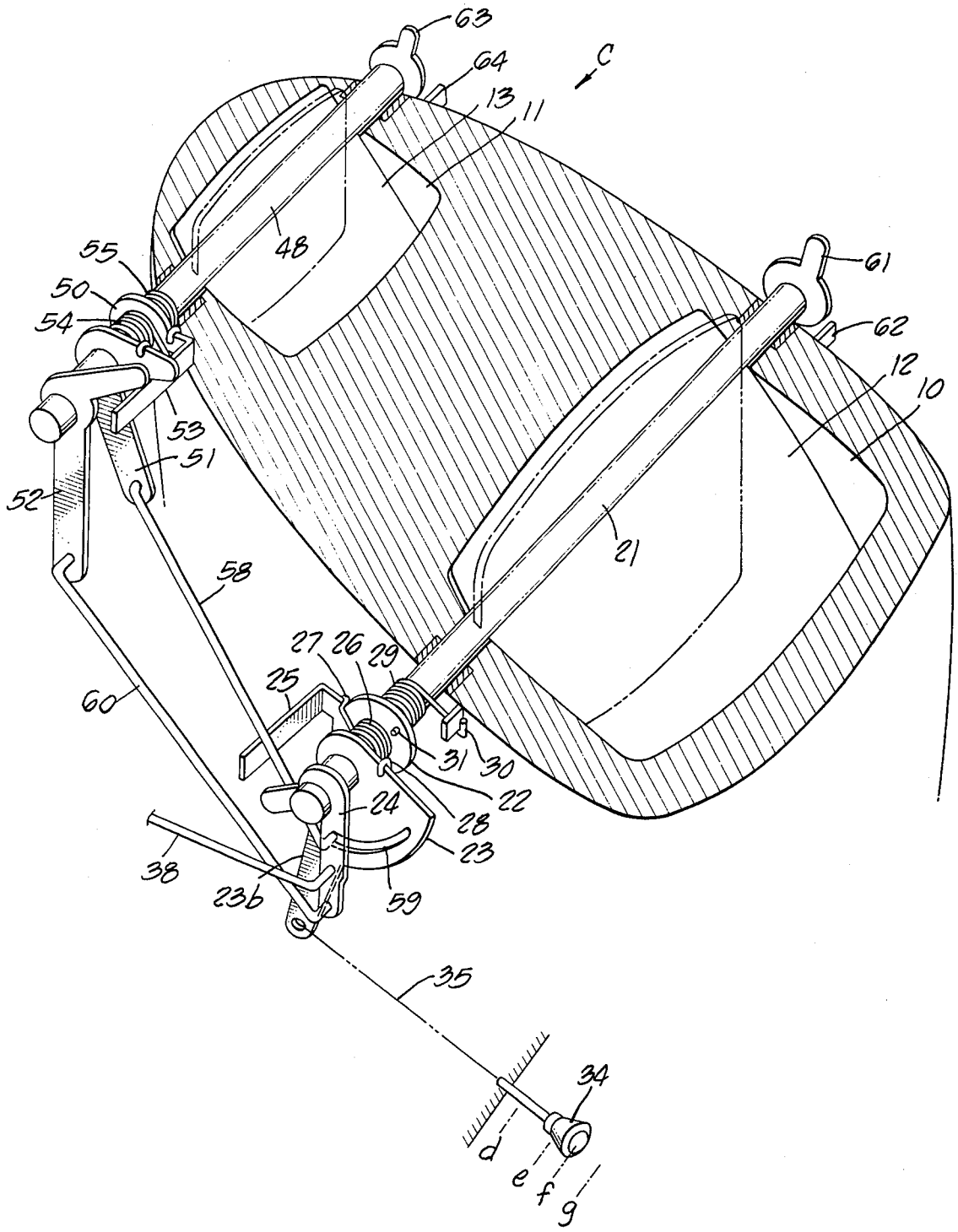
FIG. 2 is an oblique view showing a part of the apparatus in cross section.

When the engine E is at rest, the pressure in the vacuum chamber 39 of the vacuum actuator 36 is at atmospheric pressure. When the choke operating knob 34 is in the choke-off position "*d*", as shown in FIG. 2, the main choke valve 12 and the auxiliary choke valve 13 are in the open position, as shown in phantom lines. The main second choke lever 23 is contacted at 23*b* with the hook 25 by reason of the force applied by the torsion spring 26. Similarly, the auxiliary second choke lever 51 contacts with the hook 53 by reasons of the force of the torsion spring 54. When the engine is at rest and the choke knob 34 is pulled from the position "*d*" toward the position "*e*", the main second choke lever 23 moves in a counterclockwise direction, the arcuate slot 59 moving with respect to the adjacent end of the rod 58. The torsion spring 26 keeps the hook 25 in contact with the lever 23, and this turns the shaft 32 against the force of the spring 29 so that the main choke valve 12 moves from open position "*d*" to fully closed position "*e*", as shown in the full lines in FIG. 2. The auxiliary choke valve 13 remains fully open because the rod 58 has not yet moved the auxiliary second choke lever 51.

With the engine E still at rest, pulling of the choke operating knob 34 from position "*e*" to position "*f*" causes continued counterclockwise movement of the main second lever 23. Therefore the increased torsinal force on the spring 26 acts on the main choke valve as closing torque. Also, the end of the arcuate slot 59 engages with the adjacent end of the rod 58 and causes the auxiliary second choke lever 51 to move in a counterclockwise direction. The torsion spring 54 keeps the hook 53 in contact with the lever 51 and therefore the auxiliary choke valve 13 moves to fully closed position "*f*" against the action of the spring 55.

With the engine still at rest, movement of the choke operating knob 34 from position "*f*" to over-choke position "*g*" causes further continued counterclockwise movement of the main lever 23. Therefore the further increased torsional force on the spring 26 acts on the main choke valve 12 as closing torque. Also, the increased torsional force on the spring 54 acts on the auxiliary choke valve 13 as closing torque.

If the choke operating knob 34 is between the positions "*d*" and "*e*" at the time the engine is started, the main choke valve 12 is partially closed and the mixture produced in the main intake passage 10 is richer than it would be if the main choke valve 12 were fully open. If the choke operating knob 34 is located between positions "*e*" and "*f*" when the engine is started, the mixture produced in the main intake passage 10 becomes still richer and the mixture produced in the auxiliary intake passage 11 also becomes richer. If the knob 34 is located between positions "*f*" and "*g*", the closing torque on both the main choke valve 12 and the auxiliary choke valve 13 is further increased, and the mixtures produced in both intake passages 10 and 11 are made even richer, so that the air-fuel ratios in both the main combustion chamber 67 and the auxiliary combustion chamber 68 are made richer. Thus, by adjusting the position of the choke operating knob 34 the engine may be started quickly over a wide range of low temperatures.

When the engine E, on being started, reaches the state of complete firing with stable RPM, the intake vacuum of the engine is detected at the vacuum detector hole 44 and metered at the orifice 46. The internal pressure is reduced in the vacuum chamber 39 in the vacuum actuator 36, so that the flexible diaphragm 37 moves to retract the connecting rod 38. This action turns the main third choke lever 24 in a clockwise direction, while at the same time it also causes the connecting rod 60 to turn the auxiliary third choke lever 52 in a clockwise direction. At this time, if both the main choke valve 12 and the auxiliary choke valve 13 are in a closed position, the choke levers 24 and 52 engage with the hooks 25 and 53, respectively, to turn them in the same direction against the torsional force of the connecting springs 26 and 54. This opens the main choke valve 12 and the auxiliary choke valve 13. The stroke of the flexible diaphragm 37 is limited by contact with the abutment 40 so that the main choke valve 12 and the auxiliary choke valve 13 come to a stop at specified medium openings or choke pull-down angles. In this way the air-fuel ratios of the mixtures produced in each intake passage 10 and 11 is made leaner in order to accomplish optimum warmup of the engine E.

When the engine reaches a warmed up condition, the opertor pushes the choke operating knob 34 to position "*d*", thereby causing the main first and second choke levers 22 and 23 to turn clockwise under the torsional force of the connecting spring 26 and the valve opening spring 29. In this way, the main choke valve 12 is fully opened. The auxiliary choke valve 13 is simultaneously opened in the same manner.

Figure 3:
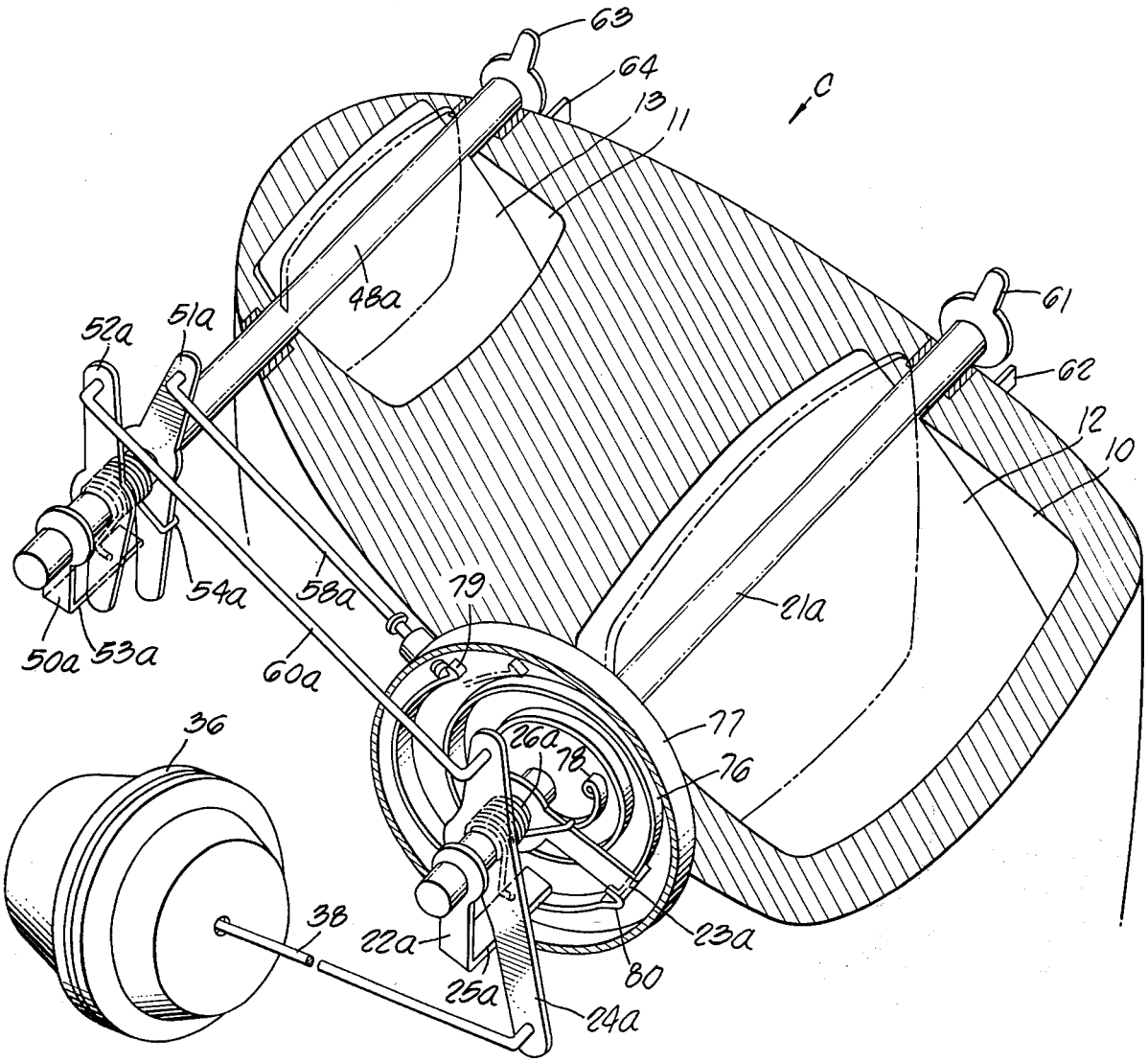
FIG. 3 is a view similar to FIG. 2 showing a modified form of the invention.

In the second embodiment of the invention shown in FIG. 3, a bimetal element 76 is employed to operate the main second choke lever, instead of the choke operating knob 34 and wire 35. A circular control case 77 is fixed to an outer wall of the carburetor C. The bimetal element 76 is of spiral shape and it contracts when heated. The inner end 78 of the bimetal element 76 is fixed to the control case 77 and the free outer end 79 is free to move within the inner circumference of the control case 77. This movement of the outer free end 79 is counterclockwise when the ambient temperature decreases. The free outer end 79 has a shoulder which contact with the projecting end of the connecting rod 58*a* when the ambient temperature reaches a predetermined low value. Another shoulder 80 is formed on the bimetal element 76 intermediate its ends, and the shoulder 80 engages with the outer swinging end of the main second choke lever 23*a*. (In this embodiment of the invention, the suffix *a* is used to designate parts which have the same function but somewhat different construction from similarly numbered parts shown in FIGS. 1 and 2.) The free outer end 79 of the bimetal element 76 together with the connecting rod 58*a* form a lost-motion connection.

In other respects, the construction of the form of the invention shown in FIG. 3 is similar to that of the previous embodiment.

When the engine ambient temperature lowers, the free outer end 79 and the shoulder 80 move counterclockwise about the valve shaft 21*a*. Such movement of the shoulder 80 causes the main second choke lever 23*a* to turn in the same direction, thereby closing the main choke valve 12 through the connecting spring 26*a* and main first choke lever 22*a*. Then, when the main choke valve 12 reaches its closed position and the engine ambient temperature continues to fall, the bimetal element 76 expands further so that the shoulder 80 moves the main second choke lever 23*a* through additionl turning movement, whereby the torsional force of the connecting spring 26*a* is increased to exert a closing torque on the main choke valve 12. As this action continues, the free end 79 of the bimetal element 76 eventually engages with the extending end of the connecting rod 58*a*, causing it to turn the auxiliary second choke lever 51*a* in a counterclockwise direction. This action closes the auxiliary choke valve 13 and increases the closing torque on that choke valve 13.

Subsequently, when the engine is started and reaches a state of complete firing with stable RPM, the vacuum actuator 36 simultaneously opens both the main choke valve 12 and the auxiliary choke valve 13, each to predetermined choke pull-down angles.

In accordance with this invention as described above, the main and auxiliary choke valves of the carburetor are interconnected with a lost-motion connection so that the main choke valve may be closed first and the auxiliary choke valve closed thereafter. This enables the overall air-fuel ratio of the mixture to be made wider in the range of concentration corrections, and is also made adjustable to a fine degree. As a result, the engine can be started easily over a wide range of temperatures between normal temperatures and severely cold conditions. Furthermore, when the engine is in the state of complete firing, the vacuum detector causes both the main and auxiliary choke valves to open to specified choke pull-down angles, so that misfire is avoided in the auxiliary combustion chamber. The overall air-fuel ratio of the mixture can be brought to a value leaner than stoichiometric in the shortest possible time, thereby promoting clean warmup operation of the engine.

Having fully described our invention, it is to be understood that we are not to be limited to the details herein set forth, but that our invention is of the full scope of the appended claims.

We claim:

1. For use with a carburetor for an internal combustion engine, the carburetor having a main intake passage for supplying main combustion chambers of the engine with a lean mixture and having an auxiliary intake passage for supplying auxiliary combustion chambers of the engine with a rich mixture, the improvement comprising, in combination: a main choke valve in the main intake passage and fixed on a shaft, a first lever fixed to the shaft, a second lever mounted to turn on the shaft, a spring acting to turn the second lever with respect to the first lever, hook means on the first lever limiting such turning movement of the second lever, an auxiliary choke valve in the auxiliary intake passage, means including an auxiliary lever for moving the auxiliary choke valve, means including a lost-motion connection between said second lever and said auxiliary lever whereby the auxiliary choke valve is moved from open position toward closed position only after predetermined closing movement of said main choke valve, a third lever mounted to turn on the shaft and engageable with said hook means, connecting means whereby said third lever may move said auxiliary choke valve, and means responsive to reduction in pressure in one of said intake passages upon starting of the engine to cause the third lever to open both choke valves.

2. The combination set forth in claim 1 in which said first means includes a manually operated element.

3. The combination set forth in claim 1 in which said first means includes a temperature responsive bimetal element.

4. For use with a carburetor for an internal combustion engine, the carburetor having a main intake passage for supplying main combustion chambers of the engine with a lean mixture and having an auxiliary intake passage for supplying auxiliary combustion chambers of the engine with a rich mixture, the improvement comprising, in combination: a main choke valve in the main intake passage and fixed on a main shaft, an auxiliary choke valve in the auxiliary intake passage and fixed on an auxiliary shaft, each shaft having a first lever fixed thereon, a second lever mounted to turn on each shaft, a third lever mounted to turn on each shaft, a spring on each shaft acting to turn the second lever with respect to the first lever, hook means on each first lever limiting such turning movement of the second lever and the third lever on the same shaft, means including a lost-motion connection between said second lever on the main shaft and said second lever on the auxiliary shaft whereby the auxiliary choke valve is moved from open position toward closed position only after predetermined closing movement of said main choke valve, a rod connecting said third levers for dependent movement, and means responsive to reduction to pressure in one of said intake passages upon starting of the engine to cause the third levers to open both choke valves.

5. The combination set forth in claim 4 in which said first means includes a manually operated element.

6. The combination set forth in claim 4 in which said first means includes a temperature responsive bimetal element.

* * * * *

UNITED STATES PATENT AND TRADEMARK OFFICE

CERTIFICATE OF CORRECTION

PATENT NO. : 4,060,062

DATED : November 29, 1977

INVENTOR(S) : Katsuhiko Tsutsui et al

It is certified that error appears in the above-identified patent and that said Letters Patent are hereby corrected as shown below:

Col. 2, line 28, "A rod 58 . . ." should start a new paragraph.

Col. 2, line 57, "exhause" should read --exhaust--.

Col. 3, line 28, "32" should read --21--.

Col. 4, line 48, "contact" should read --contacts--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*